United States Patent [19]

Purohit

[11] Patent Number: 4,588,450

[45] Date of Patent: May 13, 1986

[54] NITRIDING OF SUPER ALLOYS FOR ENHANCING PHYSICAL PROPERTIES

[75] Inventor: Ankur Purohit, Lisle, Ill.

[73] Assignee: The United States of America as represented by the United States Department of Energy, Washington, D.C.

[21] Appl. No.: 624,085

[22] Filed: Jun. 25, 1984

[51] Int. Cl.[4] ..... C22F 1/10

[52] U.S. Cl. ..... 148/20.3; 148/427

[58] Field of Search ..... 148/13.1, 16, 16.6, 148/20.3, 39, 6.3, 427

[56] References Cited

U.S. PATENT DOCUMENTS 4,043,839 8/1977 Hartline et al. ..... 148/20.3

4,264,380 4/1981 Rose et al. ..... 148/16.6

*Primary Examiner*—Christopher W. Brody

*Attorney, Agent, or Firm*—William Lohff; James W. Weinberger; Judson R. Hightower

[57] ABSTRACT

The invention teaches the improvement of certain super alloys by exposing the alloy to an atmosphere of elemental nitrogen at elevated temperatures in excess of 750° C. but less than 1150° C. for an extended duration, viz., by nitriding the surface of the alloy, to establish barrier nitrides of the order of 25–100 micrometers thickness. These barrier nitrides appear to shield the available oxidizing metallic species of the alloy for up to a sixfold improved resistance against oxidation and also appear to impede egress of surface dislocations for increased fatigue and creep strengths.

5 Claims, 7 Drawing Figures

UNTREATED
(MILL-ANNEALED)
UNTREATED
(SOLUTION-ANNEALED)
AS NITRIDED
WEIGHT GAIN, mg/cm2
1.2
1.0
0.8
0.6
0.4
0.2
0
0.01
0.1
1
10
100
OXIDATION - HOURS at 900°F

AS NITRIDED
UNTREATED
TOTAL STRAIN RANGE, %
5
1
0.5
100
1000
10000
100000
1000000
FATIGUE - CYCLES TO FAILURE at 900°F

AS NITRIDED
UNTREATED
STRESS, ksi
20
10
1
10
100
1000
10000
CREEP STRENGTH - HOURS TO RUPTURE at 900°F

NITRIDING OF SUPER ALLOYS FOR ENHANCING PHYSICAL PROPERTIES

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

It is known that certain materials can be added to iron to give preferential physical properties in alloying and forming steel. Thus, carbon, chromium, nickel, molybdenum and manganese have been commonly blended together with iron, in varying combinations and percentages, to increase tensile strength and hardness, add resistance against creep and fatigue, and improve resistance against high temperature degradation, oxidation and carbide formation.

For example, oxidation is a buildup at the surface of oxides, such as iron oxide on the conventional iron not having special additives. Certain oxide coatings, if nonporous and adherent, can reduce the rate of continued oxidation. Chromium, titanium and aluminum have very high rate of diffusion and when added to the iron become the first to oxidize. The grain boundaries and other defective regions (like dislocation lines) provide high diffusion paths for the oxidation. The oxides formed at the normal surface as well as these boundaries serve as a protective coating or barrier against continued rapid oxidation. The rate of oxidation in most metallic alloy systems containing chromium is determined largely by the rate of diffusion of the metallic species through the oxide layer. That is, the active oxidation is occurring at the oxide/oxygen (or air) interface. The diffusion rate of oxygen through the oxide layer is negligibly small.

After the formulation of the material has been settled and the metal made, certain post formation or preuse conditioning processes can be performed on these materials to further enhance their physical characteristics. Of concern, however, is the fact that most commonly, the improvement of one physical property (resistance against corrosion, for example) results in a reduction of another physical property (fatigue strength, for example). Thus, annealing improves mechanical strengths against fatigue and creep particularly at elevated temperatures and reduces stress buildups incidental to cold forming. However, annealing also generally reduces the basic tensile strength, hardness, and improves ductility at elevated temperatures. Nitriding and carburizing might be used for improving the surface hardness and resistance against wear.

"Super alloys" are also available, using nickel as a primary material with some of these same additives also as the primary materials, and minor percentages or only traces then of iron. Some examples of specific "super alloys" are:

(a) Inconel 625 having approximately 22–25% chromium, 61% nickel, 8–10% molybdenum, 3.5% niobium, 3.5% iron and traces of aluminum and titanium.

(b) Inconel 600 having approximately 15% chromium, 72% nickel, 8% iron, and traces of carbon, manganese, copper and silicon.

(c) Inconel 718 having approximately 17–22% chromium, 50–55% nickel, 4% niobium plus tantalum, 3% molybdenum, traces of manganese, silicon, copper, carbon, aluminum, cobalt and the balance of iron.

(d) Inconel 750 having approximately 15% chromium, 70% nickel, 7% iron, and traces of carbon, manganese, silicon, titanium and aluminum.

Each super alloy, by its nature, is intended to operate in areas of high demand where mere survival could be a success. The blends and proportions of the base materials and additives forming the various super alloys differ from one another in order to accomplish specific purposes for the alloy. Thus, large proportions of nickel add resistance against corrosion and increase hardness; increased percentages of chromium add durability and resistance against oxidation at high temperatures while yet having high tensile strength, increased molybdenum in ranges even up to 9% add strength and resistance against high temperature degradation and resistance against creep and fatigue; while increased percentages of niobium provide resistance against carbide formation.

The super alloys have melting points in the range of 1300°–1350° C. and high strengths at temperatures even above 650°–825° C. The super alloys also generally provide good resistance to fatigue and creep even at high temperatures and in corrosive atmospheres, and high resistance to oxidation that can be two to five times better than stainless steels. This would include high resistances against corrosion from marine or urban pollution, ammonia, hydrogen sulfide and sulfur dioxide for temperatures even in excess of 900° C. Thus, any improvement in the performance of any of these super alloys with respect to fatigue strength, or in resistance against creep, or in resistance against oxidation, even if obtained singularly would represent a contribution to the art; but if obtained simultaneously, would be most significant.

SUMMARY OF THE INVENTION

This invention relates to super alloys which by design have high resistance to oxidation, fatigue and creep, even at high temperatures and in very corrosive conditions; and specifically to a post-formation of preuse conditioning of the super alloy which in tests unexpectedly increases its resistance against corrosion by a factor even up to 6 times, increases its resistance against creep by up to 20%, and increases its resistance against fatigue by up to 50%, when compared to the same super alloy not so treated according to this invention.

This invention relates specifically to the preuse conditioning of the super alloy by nitriding at high temperatures for a sustained duration. The nitriding uses atomic nitrogen (such as dissociated ammonia at high temperature where the metallic surface acts as a catalyst in the uptake of nitrogen) and provides exposing the super alloy to this nitrogen at temperatures in excess of 750° C. but generally less than 1150° C. for a period longer than several minutes but generally less than a day. The nitrogen diffuses into the material, starting at the surface and working inwardly, particularly via the grain and subgrain boundary regions and the dislocation lines and combines with the constituents of the alloy to form complex nitrides. The nitride buildup (as a layer of the order of 25–200 micrometers thickness inwardly from the surface) restricts the high diffusion paths and thereupon slows down even the initial rate of oxidation diffusion of chromium, iron or of any other material that would normally be oxidated. This nitriding also unexpectedly increases resistance against both creep and fatigue.

BRIEF DESCRIPTION OF THE DRAWINGS

FIG. 1 showing a mill-annealed specimen;

FIG. 2 showing a solution-annealed specimen;

FIGS. 3 and 4 showing a solution-annealed specimen that has been nitrides according to this invention.

DETAILED DESCRIPTION OF THE PREFERRED EMBODIMENT

Specimens of several types of super alloys (specifically Inconel 625, Inconel 600, Inconel 718 and Inconel X-750) were nitrided according to this invention, and were compared against its counterpart untreated specimen in standard performance tests at elevated temperatures. Of the Inconel 625 specimens, one type of specimen was mill-annealed, one type of specimen was solution-annealed, and one type of specimen was solution-annealed and nitrided according to the practice of this invention. The three types of specimens were then subjected to various fatigue, creep, and oxidation tests for comparative analysis. Hot rolled specimens of the Inconel 600, Inconel 718, and Inconel X-750 were also either left untreated or were nitrided according to this invention; and oxidation tests for comparative analysis were conducted on these specimens.

EXAMPLE I

Inconel 625

Specimens of solution-annealed Inconel 625 of nominal thickness of 0.635 mm were nitrided in an ammonia-rich atmosphere at 1100±20° C. for 45 minutes and were subsequently quenched in a cooled nitrogen atmosphere to 320±20° C. before exposure to air. These nitrided specimens of solution annealed Inconel 625 were compared against untreated corresponding solution-annealed specimens and against untreated mill-annealed specimens.

Figure 1:
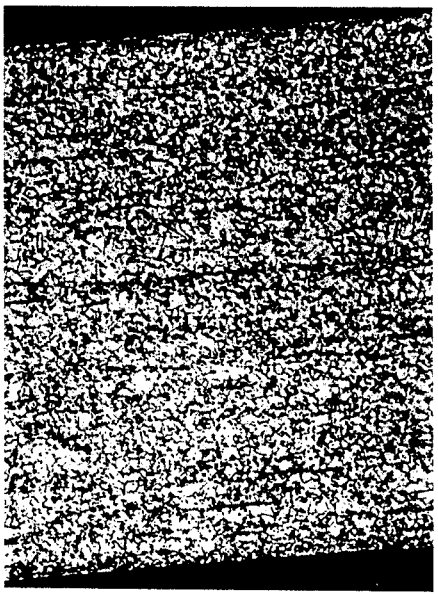
FIGS. 1, 2 and 3 are photomicrographs, each at 130 times magnification.
Figure 4:
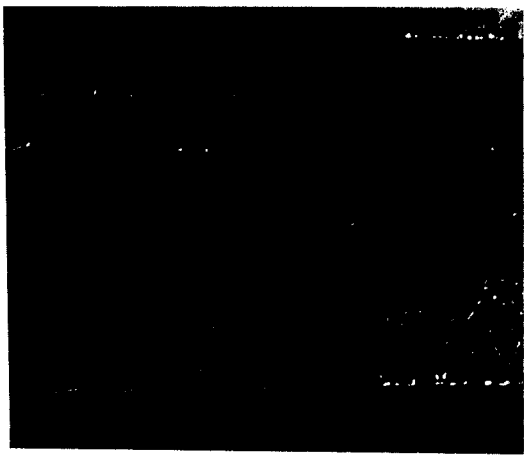
FIG. 4 is a photomicrograph at 520 times magnification, of a polished cross section of various specimens specifically snhowing the grain boundaries interiorally of the specimen surface.
Figure 2:
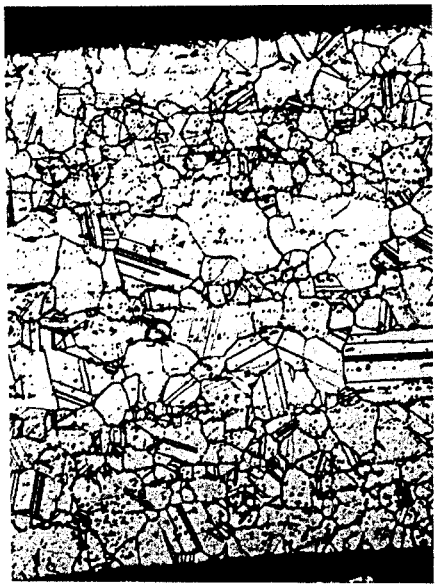
Figure 3:
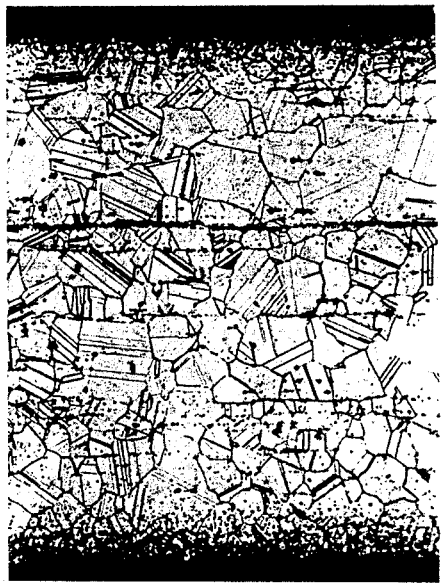

As noted, FIGS. 1, 2 and 3 are photomicrographs, each at 130 times magnification, an FIG. 4 is a photomicrograph at 520 times magnification, of a polished cross section of various specimens specifically showing the grain boundaries interiorally of the specimen surface. FIG. 1 shows a mill-annealed specimen, FIG. 2 shows a solution-annealed specimen, and FIGS. 3 and 4 show solution-annealed specimen that had been nitrided according to this invention.

The nitride buildup, as illustrated in FIG. 3 by the black dots, is concentrated at and near the surface region. FIG. 4, at 520 times magnification, even more graphically illustrates the nitride buildup as individually raised precipitates more heavily concentrated at and near the surface of the material, as a layer of the order of 25–100 micrometers thick. FIG. 4 was taken in a differential interference contrast mode with the surface being in an as-polished state.

This nitride buildup at the surface gives the specimen improved resistance against oxidation, where the paths of diffusion via the grain boundaries appear to be blocked by the nitrides. Furthermore, the nitrided surface layer appears to impede egress of dislocations coming through the surface, thereby increasing the resistance against fatigue and creep deformations.

Figure 5:
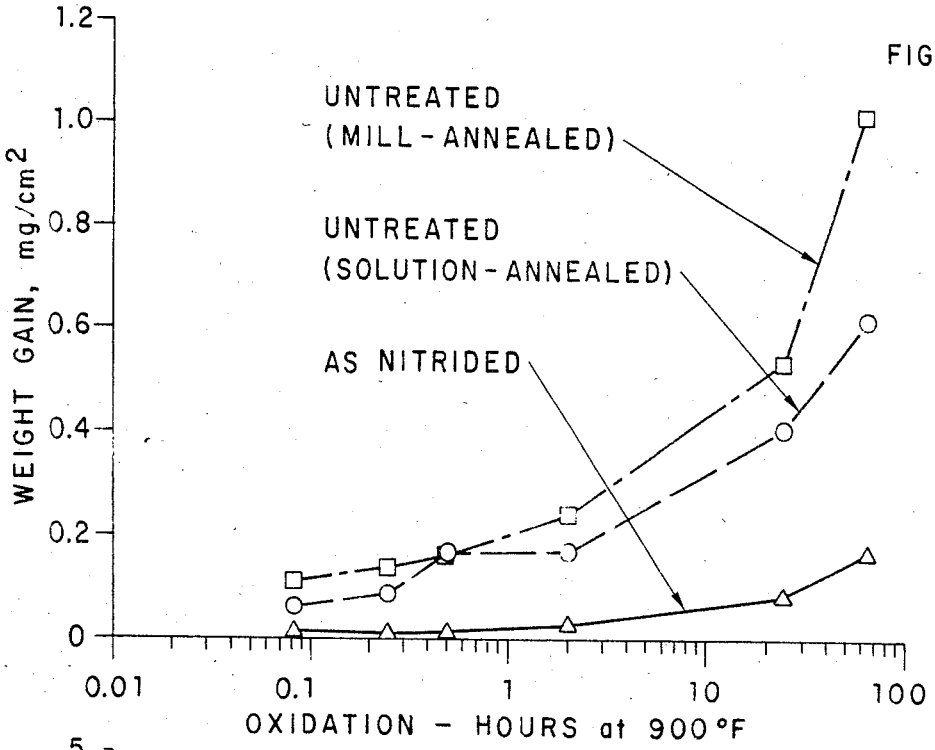
FIGS. 5, 6 and 7 are graphs of test data showing comparative results of the nitrided and untreated specimens for oxidation, fatigue and creep, respectively.

The comparative specimens were then subjected to oxidation tests in an atmosphere of air at elevated temperatures higher than 900° C. for extended durations. The weight gain was accurately measured to characterize the oxide buildup, and a percentage of weight gain per unit of surface area of the specimen obtained; whereby these weight gain percentage values for the nitrided and the untreated specimens could be compared. FIG. 5 shows on a single log scale graph the significantly reduced oxide buildup for the nitrided specimen versus the untreated specimens: approximately 15% that of the corresponding untreated solution-annealed specimen and approximately 10% that of the untreated mill-annealed specimen. This represents approximately a sixfold improvement against oxidation brought about by nitriding the specimens according to this invention. Examination of the photomicrographs in FIGS. 1 and 2 of the untreated mill-annealed and solution-annealed specimens indicates the greater number of grain boundaries in the former as compared to the latter, which explains its greater susceptibility against oxidation.

Figure 6:
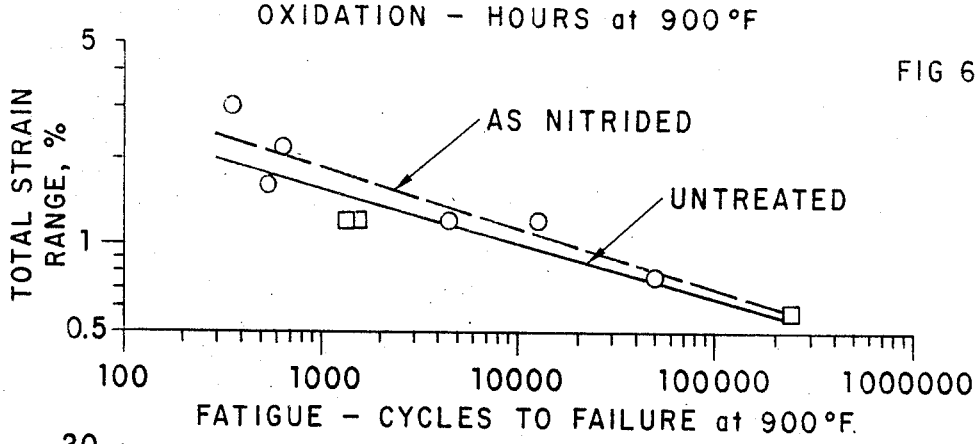

With respect to fatigue tests, the nitrided specimens were subjected to reverse bend fatigue tests, as were the untreated solution-annealed specimens, at test temperatures of 900° C., 1000° C. and 1100° C. in laboratory air. In these tests, the specimens were subjected to different total strain amplitudes, and were then cycled to failure. A best-fit curve interpretation of the data at 900° C. is illustrated in FIG. 6 on the double log scale graph which shows a comparative improvement for the nitrided versus the untreated specimen of approximately 10% in expected cycle life or allowable strain amplitude.

Figure 7:
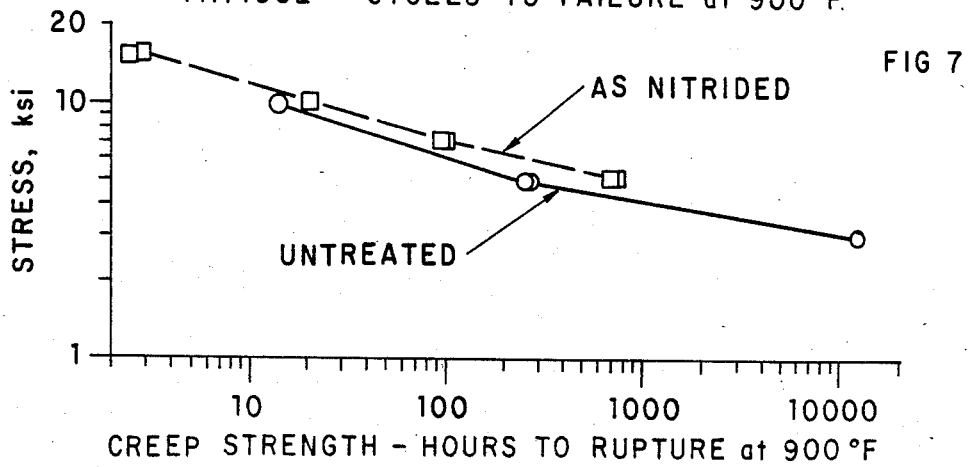

With respect to creep, the specimens were stressed in tension under a steady load at 900° C. in laboratory air until failure, and the duration of lapsed time was recorded. The nitrided specimens lasted in excess of 20% longer than comparable untreated specimens, as shown by the double log scale graph of FIG. 7.

The specimens of the additional super alloys of Inconel 600, Inconel 718 and Inconel X-750 were nitrided in an atmosphere of ammonia (class 601) at 1125±25° C. for a duration of 30±10 minutes, with a subsequent quench cooldown in a cool disassociated ammonia atmosphere to below 320±20° C. before exposure to air. These specimens were the basis for the following examples.

EXAMPLE II

Inconel 600

Oxidation tests at 900° C. for 17.25 hours in laboratory air of the nitrided specimens of Inconel 600 and the counterpart untreated specimen were conducted, and the nitrided specimen exhibited a 0.05497% weight gain versus a 0.08642% weight gain for the untreated specimen. This represents a 57.2% improvement against oxidation buildups brought about by nitriding super alloy according to this invention.

EXAMPLE III

Inconel 718

Oxidation tests at 900° C. for 24.0 hours in laboratory air of the nitrided specimens of Inconel 600 and the counterpart untreated specimen were conducted, and the nitrided specimen exhibited a 0.0323% weight gain versus a 0.0406% weight gain for the untreated specimen. This represents a 20.44% improvement against oxidation buildups brought about by nitriding super alloy according to this invention.

EXAMPLE IV

Inconel X-750

Oxidation tests at 900° C. for 24.0 hours in laboratory air of the nitrided specimens of Inconel 600 and the counterpart untreated specimen were conducted, and the nitrided specimen exhibited a 0.0358% weight gain versus a 0.0659% weight gain for the untreated specimen. This represents a 45.7% improvement against oxidation buildups brought about by nitriding super alloy according to this invention.

While the benefits of nitriding have long been known, it does not seem apparent to nitride any of the noted super alloys in order to improve the physical properties of the respective super alloy. For example, one accepted theory why certain super alloys are so resistant to corrosion is because of the presence at the surface of the retarding additives, chromium, for example. One might anticipate then that any surface treating of a super alloy, specifially by nitriding, would allow the nitrogen atoms to take the chromium away from the system, thereby leaving it more vulnerable to oxidation. In fact, this appears to be true with respect to the somewhat parallel preuse conditioning process of carburizing (versus nitriding) where carburized atoms do attract the fortifying element in the alloy to reduce its effectiveness against oxidation. However, nitriding to provide a nitride buildup of the order of 25–100 micrometers in the grain boundaries of the super alloy unexpectedly increases the resistance against oxidation, and by substantial percentages.

It is, moreover, of interest to note also the improvements in the resistance against both fatigue and creep failures experienced with the nitrided specimens, compared against the untreated specimens. Normally, any surface treatment effective to improve oxidation results in establishing a brittle surface barrier that as a side effect reduces the effectiveness against both fatigue and creep strengths. With the nitrided layer 25–100 micrometers thick at the surface of the specimen, even the fatigue and creep strengths were found to have been improved.

The invention could also be practiced on a highly localed basis, such as for the preconditioning of locations of weakness or stress concentrations in order to improve durability and life. These might include mechanical gears or key slots on shafts, etc., for example. The nitriting process might be performed nominally at room temperatures in the properly concentrated nitrogen atmosphere, where a laser beam or an electron beam would be directed against the gear surface to provide only localized heating to the 750°–1100° C. temperature range to nitride the surface to the 25–100 micrometer thickness desired. However, by sweeping the beam back and forth selectively over the surface, specific local and possibly widespread nitriding can be done for improving the physical properties of the structure, including increasing the resistance against oxidation and the fatigue and creep strengths The embodiments of the invention in which an exclusive property or privilege is claimed are defined as follows:

1. A process of improving the high temperature physical properties of a super alloy having a thickness, containing at least about 67% of Cr and Ni, and having a melting temperature in the range of 1300°–1350° C.; comprising the step of exposing the alloy to an atmosphere of elemental nitrogen (N vs $N_2$) at elevated temperatures in excess of 750° C. but less than 1150° C. for a time sufficient to nitride at least some of the surface of the alloy and establish barrier nitrides for shielding the available oxidizing metallic species of the alloy, the barrier nitrides extending to a depth in the order of 25–100 micrometers but substantially less than the thickness of the alloy.

2. The process according to claim 1, further providing that the alloy is exposed to the elemental nitrogen atmosphere for a duration exceeding several minutes.

3. The process according to claim 1, further providing that the alloy is quenched in a cool atmosphere of nitrogen to below 320° C. before exposing the alloy to air.

4. The process according to claim 1, further providing that the alloy is exposed to ammonia-rich atmosphere at 1100±20° C. for 45 minutes.

5. The process according to claim 4, further providing a quench cooldown in a core dissociated ammonia atmosphere to below 320±20° C. before exposure to air.

* * * * *